United States Patent [19]

Barr

[11] Patent Number: 5,072,715

[45] Date of Patent: Dec. 17, 1991

[54] SLINGSHOT INCORPORATING IMPROVED FEATURES FOR INCREASED ENERGY STORAGE AND ENHANCED PERFORMANCE

[76] Inventor: David W. Barr, 223 La Fonda, Houston, Tex. 77060

[21] Appl. No.: 514,152

[22] Filed: Apr. 25, 1990

[51] Int. Cl.[5] ..... F41B 3/02

[52] U.S. Cl. ..... 124/20.1; 124/17

[58] Field of Search ..... 124/20.1, 20.3, 25.6, 124/25, 22, 17, 21

[56] References Cited

U.S. PATENT DOCUMENTS

| | | | |
|---|---|---|---|
| 316,525 | 4/1885 | Cooper | 124/20.1 X |
| 1,072,988 | 9/1913 | Pratt et al. | 124/20.1 X |
| 1,153,415 | 9/1915 | Beaty | 124/20.1 X |
| 2,853,992 | 9/1958 | Wheeler | 124/20.3 X |
| 3,524,439 | 8/1970 | Dantzler | 124/20.3 |
| 3,749,075 | 7/1973 | Saunders | 124/20.1 |
| 3,812,834 | 5/1974 | Saunders | 124/20.1 |
| 3,857,379 | 12/1974 | Burghardt | 124/20.1 |
| 3,865,094 | 2/1975 | Sweeney | 124/20.1 |
| 3,875,923 | 4/1975 | Horel | 124/20.1 |
| 3,901,209 | 8/1975 | Woolsey et al. | 124/20.1 |
| 3,918,427 | 11/1975 | Turner | 124/20.3 |
| 3,923,034 | 12/1975 | Wolf | 124/20.1 |
| 3,949,729 | 4/1976 | Pfotenhauer | 124/20.3 |
| 3,974,820 | 8/1976 | Ott | 124/20.1 |
| 3,983,860 | 10/1976 | Bolton | 124/20.1 |
| 4,050,438 | 9/1977 | Pfotenhauer | 124/20.1 |
| 4,050,439 | 9/1977 | Rudy | 124/20.1 |
| 4,133,333 | 1/1979 | Janssen | 124/20.1 |
| 4,169,453 | 10/1979 | Hunsicker | 124/20.1 |
| 4,198,949 | 4/1980 | Cook | 124/20.1 |
| 4,250,861 | 2/1981 | Ellenburg | 124/20.1 |
| 4,273,094 | 6/1981 | Hogan | 124/20.1 |
| 4,278,065 | 7/1981 | Wales | 124/20.1 |
| 4,332,230 | 6/1982 | Lozier | 124/20.1 |
| 4,373,503 | 2/1983 | Saunders | 124/20.1 |
| 4,411,248 | 10/1983 | Kivenson | 124/20.1 |
| 4,458,658 | 7/1984 | Blair | 124/20.1 |
| 4,703,744 | 11/1987 | Taylor et al. | 124/20.3 X |

FOREIGN PATENT DOCUMENTS

| | | | |
|---|---|---|---|
| 872927 | 6/1971 | Canada | 124/20.1 |

OTHER PUBLICATIONS

Angus Laidlow, "Now:Super Accurate Slingshots", *Popular Mechanics*, Jan. 1984, 4 pages.

*Primary Examiner*—Peter M. Cuomo
*Attorney, Agent, or Firm*—John R. Flanagan

[57] ABSTRACT

An improved slingshot includes an elongated mainframe and a fork assembly pivotally mounted about a transverse axis at the forward end of the mainframe. The fork assembly includes a pivotal flip-fork resiliently biased to normally assume a lowered neutral non-shooting position in which is lies below the path of flight of a projectile shot by the slingshot. The flip-fork is pivotally movable against the bias to an upright shooting position upon stretching of a power band connected to the flip-fork. Upon being moved to its shooting position, the flip-fork stores energy in addition to that being stored in the elastic power band as the latter is stretched to load the slingshot. The mainframe of the slingshot includes a hand grip located between forward and rearward ends of the mainframe and rearward and forward frame portions extend respectively rearwardly and forwardly of the hand grip. The rearward frame portion is connected to a lower end of the hand grip for placement under a user's wrist and forearm when the hand grip is held by the user's hand, whereas the forward frame portion is connected to an upper end of the hand grip and extends inclined forwardly and downwardly therefrom so as to position the forward end of the mainframe on a centerline through a user's arm and hand holding the slingshot.

27 Claims, 6 Drawing Sheets

SLINGSHOT INCORPORATING IMPROVED FEATURES FOR INCREASED ENERGY STORAGE AND ENHANCED PERFORMANCE

BACKGROUND OF THE INVENTION

1. Field of the Invention

The present invention generally relates to slingshots and, more particularly, is concerned with a slingshot having improved features for increased energy storage and enhanced performance.

2. Description of the Prior Art

Slingshots have long been known and have been easily and inexpensively made since rubber became readily available. The early slingshots were fashioned with hand carved wooden handles, most simply from a forked tree branch. Slings or power bands in the form of elastic strips of automobile inner tube rubber were attached to the handle and to a leather thong or pocket by simple means. To use the slingshot, a person gripped the handle with one hand, placed an object in the leather pocket and pulled back on the elastic strips with the other hand, stretching the strips while holding the object by gripping the pocket. After aiming, the object and pocket are released and the object propelled toward the target as the elastic strips contract from their stretched position.

More sophisticated slingshots have been developed as man has applied advanced knowledge and materials to their construction. Representative of these more sophisticated slingshots are the ones disclosed in U.S. Patents to Saunders (U.S. Pat. Nos. 3,749,075; 3,812,834; and 4,373,503), Burghardt (U.S. Pat. No. 3,857,379), Sweeney (U.S. Pat. No. 3,865,094), Horel (U.S. Pat. No. 3,875,923), Woolsey et al (U.S. Pat. No. 3,901,209), Wolf (U.S. Pat. No. 3,923,034), Pfotenhauer (U.S. Pat. Nos. 3,949,729 and 4,050,438), Ott (U.S. Pat. No. 3,974,820), Bolton (U.S. Pat. No. 3,983,860), Rudy (U.S. Pat. No. 4,050,439), (U.S. Pat. No. 4,198,949), Ellenburg (U.S. Pat. No. 4,250,861), Hogan (U.S. Pat. No. 4,273,094), Wales (U.S. Pat. No. 4,278,065), Lozier (U.S. Pat. No. 4,332,230), Kivenson (U.S. Pat. No. 4,411,248) and Blair (U.S. Pat. No. 4,458,658). A general state of the art survey of modern slingshot construction and use is contained in a January 1984 article in *Popular Mechanics* magazine.

Notwithstanding recent advances in construction of slingshots, many problems still exist. Wrist braces have been added to some slingshots for the purpose of stabilizing the slingshot so that the user can hold it more steadily while discharging the shot. Even with wrist braces, however, prior art slingshots necessarily have the characteristic of tending to cause a bending of the elbow of the user's arm holding the handle as the other arm stretches the elastic power bands, causing the two arms of the user to be straining against each other. Elimination of the recoil that occurs when the power bands release their energy is a problem area.

Also, designers are continually seeking ways to increase the amount of stretch and thus the energy that may be stored in the power bands without exceeding reasonable limits as to the overall length of the slingshot. Further, a common point of failure of prior art devices is the region of the power bands where they attach to the slingshot yoke or fork due to the concentration of stresses at that point. Additionally, accuracy of the slingshot is adversely affected by the difficulty in making both elastic power bands exactly the same length.

Still further, a recurring annoyance is the tendency of the projectile to occasionally hit the fork instead of passing between its arms as intended. Another annoying distraction which lessens the slingshot's accuracy is the necessity for the user to hold the projectile in place in the leather pouch by gripping it through the pouch while pulling the power bands to impart energy.

In view of the aforementioned problems of prior art slingshot construction, a need still exists for improvements.

SUMMARY OF THE INVENTION

The present invention provides a slingshot which includes several improved features designed to overcome most, if not all, of the above-cited problems and to satisfy the aforementioned need. While these improved features are particularly adapted for working together to enhance overall performance of the slingshot, it is readily apparent that such features may be incorporated either singly or together in slingshots as desired.

One improved feature in the slingshot of the present invention is the provision of an elongated mainframe and a fork assembly pivotally mounted about a transverse axis at the forward end of the mainframe so as to increase storage of energy and enhance slingshot performance. The fork assembly includes a pivotal flip-fork resiliently biased to normally assume a lowered neutral non-shooting position. However, the flip-fork is pivotally movable against the bias to an upright shooting position upon stretching of a power band connected to the flip-fork. Upon being moved to its shooting position, the flip-fork stores energy in addition to that being stored in the power band as the latter are stretched to load the slingshot. The flip-fork of the fork assembly improves slingshot performance by moving to its neutral non-shooting position below the path of travel of the projectile and pouch holding the projectile, after release of the stretched power band, to avoid being inadvertently hit by the band as it moves past the fork assembly.

Another improved feature in the slingshot of the present invention is the configuration of the mainframe which lessens or diminishes the forces tending to bend the elbow of the user's arm holding the mainframe as the power band is stretched. As a result, discomfort of the user in trying to maintain the holding arm straight against the force exerted by the pulling arm is reduced. Also, the recoil occurring in the user's holding arm when the projectile and power band are released is lessened.

A further feature in the slingshot of the present invention is provision of a hollow fork structure for the flip-fork of the fork assembly. Preferably, the fork structure has a hollow tubular configuration which permits attachment of the power band as a single continuous piece to the fork assembly by passing it through opposite open ends and the hollow interior of the fork structure. Such mode of attachment increases the effective length of the power band and thus the amount of energy that the band will store without also increasing its overall length. Furthermore, at the same time, stress concentrations are reduced in the band and the requirement to equalize separate lengths of elastic bands is eliminated.

A still further improved feature in the slingshot of the present invention is the provision of a projectile receiving pouch which will retain the projectile once positioned therein without the necessity of continually gripping it through the pouch. Also, the pouch is provided with a hand grip which can easily be grasped for pulling and stretching the power band.

These and other improved features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
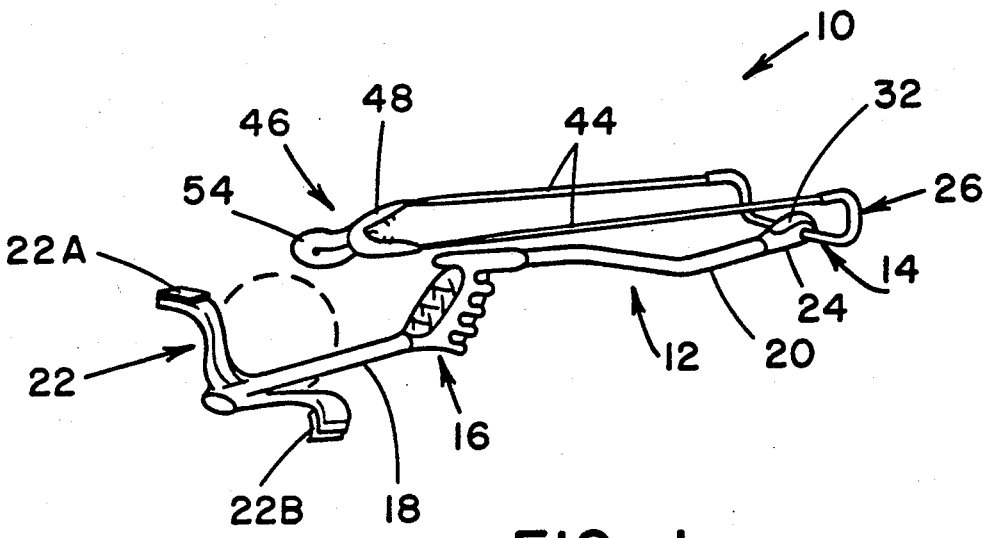
FIG. 1 is a perspective view of a slingshot incorporating the improved features of the present invention.
Figure 2:
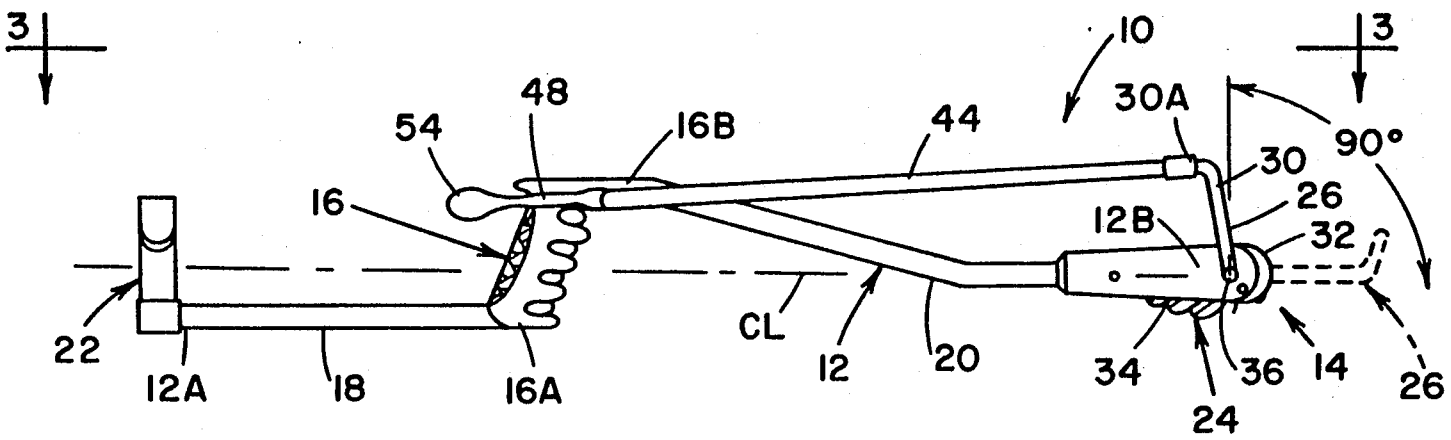
FIG. 2 is an enlarged side elevational view of the slingshot of FIG. 1.
Figure 3:
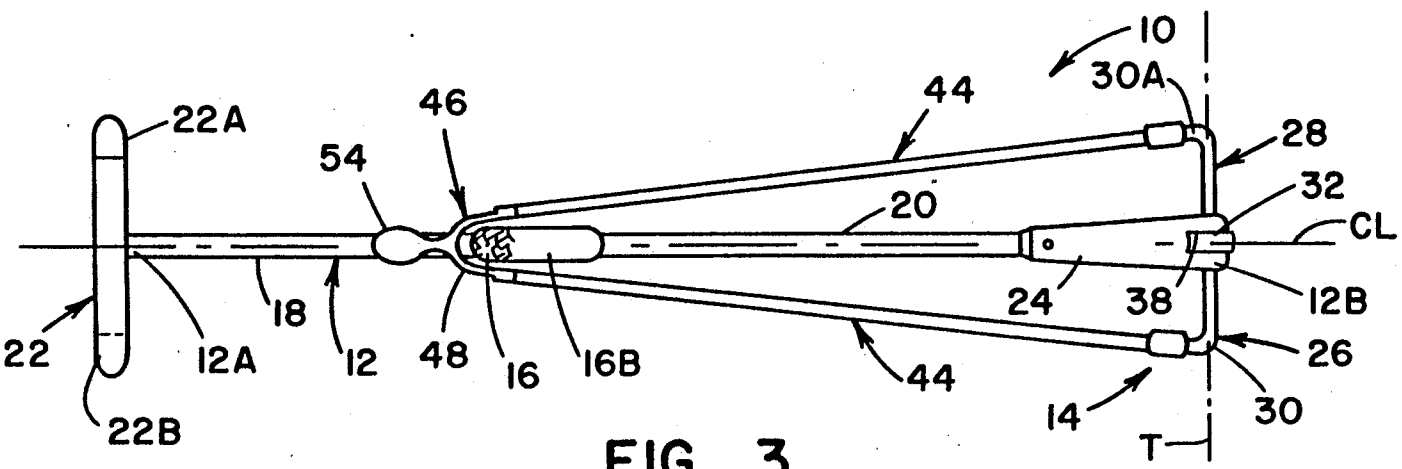
FIG. 3 is a top plan view of the slingshot as seen along line 3—3 of FIG. 2.

Referring now to the drawings, and particularly to FIGS. 1-3, there is shown a slingshot, generally designated by the numeral 10, which incorporates the improved features of the present invention. Several of the improved features incorporated by the slingshot 10 include an elongated mainframe 12 and a fork assembly 14 pivotally mounted on a forward end of the mainframe.

Figure 4:
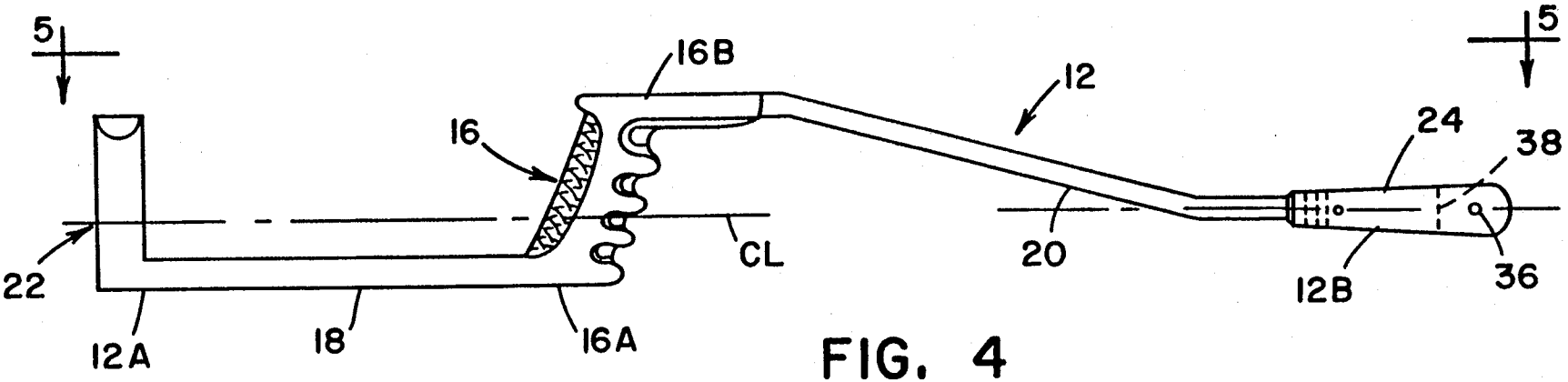
FIG. 4 is an enlarged side elevational view of a mainframe of the slingshot of FIG. 1.
Figure 5:
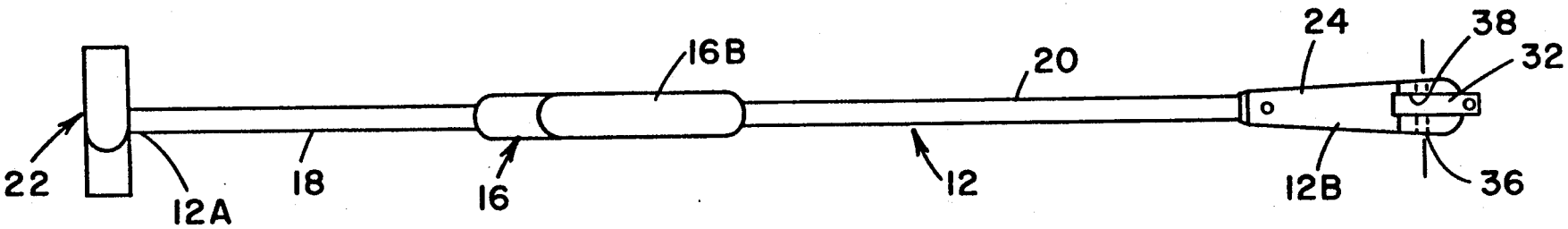
FIG. 5 is a top plan view of the slingshot mainframe as seen along line 5—5 of FIG. 4.
Figure 13:
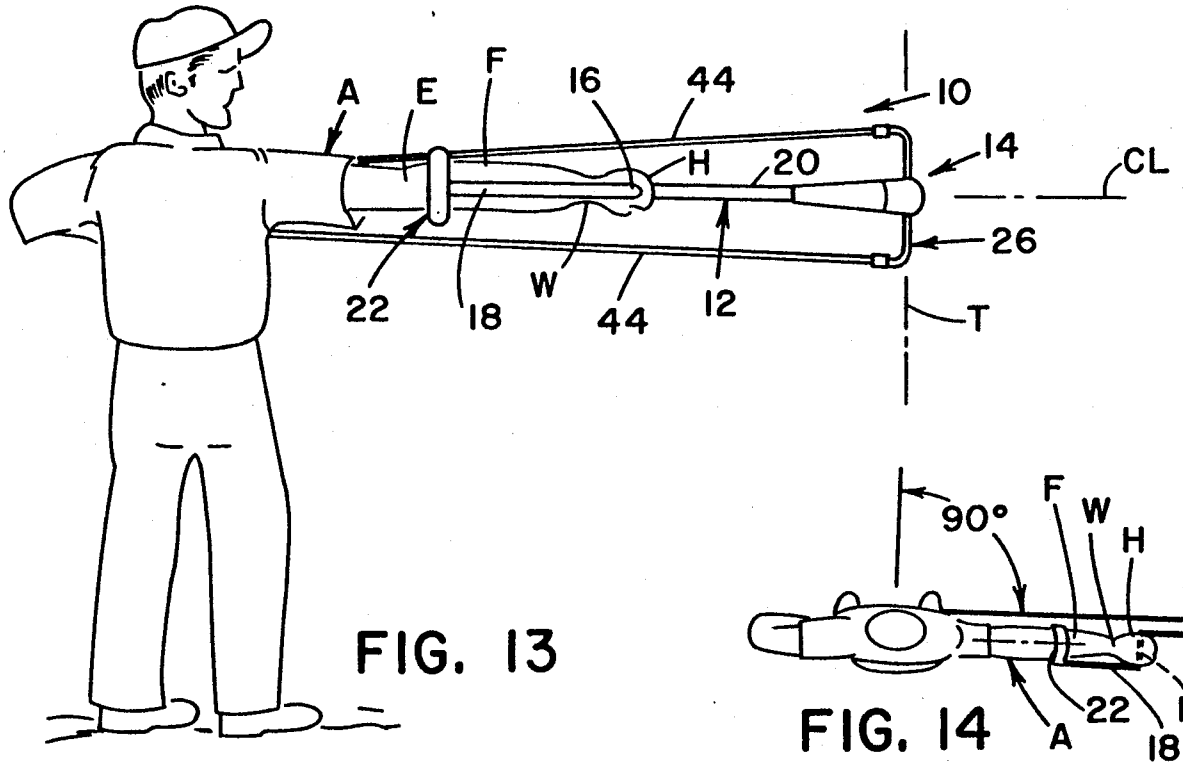
FIG. 13 is a side elevational view of a user holding the slingshot of FIG. 1 in one arm and pulling back on the elastic power band thereof with the other arm to stretch the power band and move the fork assembly to its upright shooting position.
Figure 14:
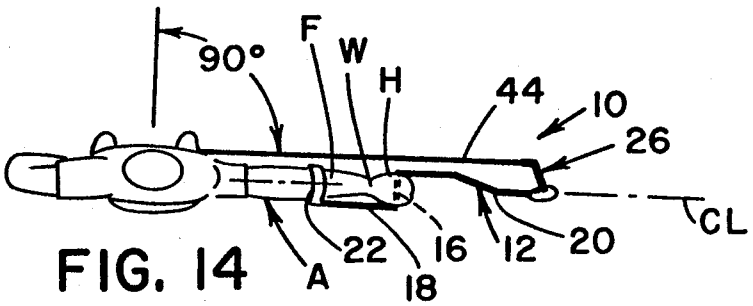
FIG. 14 is a top plan view taken along line 14—14 of FIG. 13.

Referring also to FIGS. 4 and 5, the mainframe 12 of the slingshot 10 has opposite rearward and forward ends 12A, 12B and includes means for grasping and holding the mainframe 12 by a user's hand H, for instance, in the user's right hand as seen in FIGS. 13 and 14. The holding means is in the form of a handle or hand grip 16 located intermediately between the rearward and forward ends 12A, 12B of the mainframe 12. Further, the slingshot mainframe 12 includes rod-like rearward and forward frame portions 18, 20 which extend in opposite directions from the hand grip 16.

The rearward frame portion 18 of the mainframe 12 extends rearward from the hand grip 16 to the rearward end 12A of the mainframe 12 and is rigidly connected to a lower end 16A of the hand grip 16. As is shown in FIGS. 13 and 14, the rearward frame portion 18 underlies and extends along a user's wrist W and forearm F when the hand grip 16 is held in the user's hand H.

Also, securing means 22 is attached to the rearward frame portion 18 at the rearward end 12A of the slingshot mainframe 12 for wrapping about the user's forearm F adjacent to and forwardly of the elbow E for securing the mainframe 12 to the user's arm A. The securing means 22 can take any suitable form, for instance, a flexible strap having fasteners, such as velcro strips or patches 22A, 22B on its opposite ends for easily fastening and unfastening the strap ends.

The forward frame portion 20 of the mainframe 12 extends forward from the hand grip 16 to the forward end 12B of the mainframe 12 and within the plane of the hand grip 16 and the rearward frame portion 18. More particularly, the forward frame portion 20 is rigidly connected to an upper end 16B of the hand grip 16 and extends in an inclined forwardly and downwardly relation to the upper hand grip end 16B from above to along a centerline CL extending through the user's one arm A with the hand H grasping the hand grip 16 and holding the mainframe 12, as can be seen in FIGS. 13 and 14. The forward frame portion 20 has a hollow head element 24 fastened thereon at the forward end 12B of the mainframe which mounts the fork assembly 14.

Figure 6:
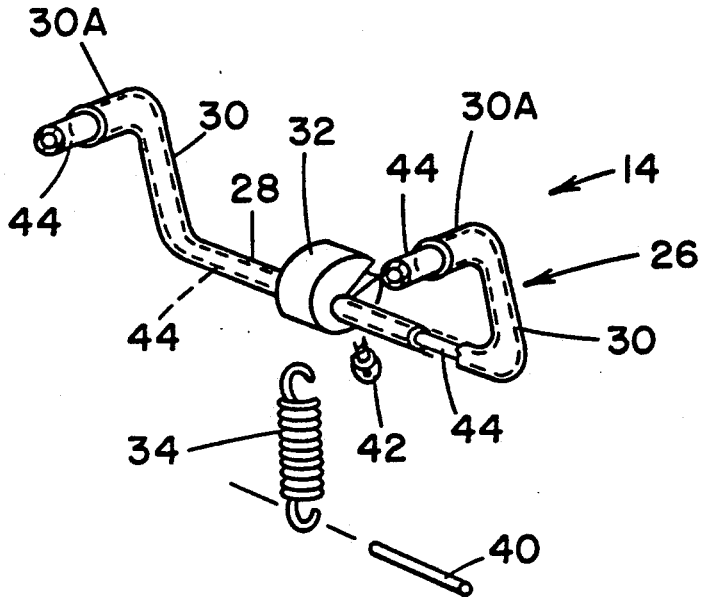
FIG. 6 is an enlarged exploded perspective view of a fork assembly of the slingshot of FIG. 1, illustrating a power band passing through the hollow structure of a flip-fork of the slingshot fork assembly.

The fork assembly 14 of the slingshot 10 is pivotally mounted to the head element 24 at the forward end 12B of the mainframe 12 about a transverse axis T which extends in orthogonal relation to the arm centerline CL and the plane of the mainframe 12. More particularly, the fork assembly 14 includes a generally U-shaped flip-fork 26 having an approximately linear bight portion 28 and a pair of arm portions 30 bent or formed at approximately right angles to and at opposite ends of the bight portion 28. The arm portions 30 terminate in rearwardly curved or hooked ends 30A. Preferably, the structure of the flip-fork 26 has a hollow tube-like or tubular configuration, as shown in FIG. 6, the advantages of which will become clear later on. Alternatively, the structure of the flip-fork 26 can have a solid rod-like configuration.

The fork assembly 26 also includes a stop element preferably in the form of an eccentric cam 32 and a biasing means preferably in the form of a coiled expansion spring 34. The head element 24 on the forward frame portion 20 has a transverse bore 36 through which the bight portion 28 of the flip-fork 26 is mounted for pivotal movement about the transverse axis T. Further, the head element 24 has a vertical slot 38 defined through its forward end. The cam 32 is fastened by clamp bolt 38 on the bight portion 28 of the flip-fork 26 midway between the arm portions 30 thereof and within the slot 38.

Figure 7:
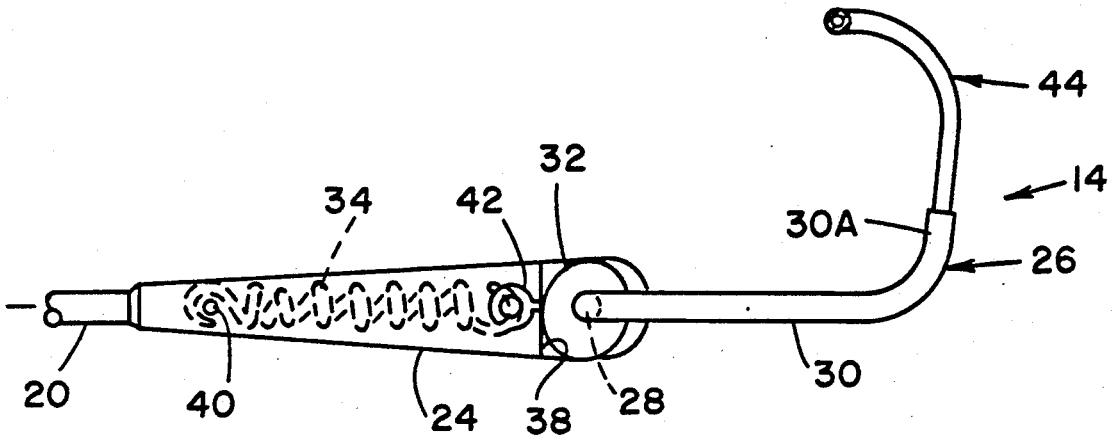
FIG. 7 is a schematic fragmentary view of the fork assembly and the forward end of the mainframe of the slingshot of FIG. 2, showing the flip-fork of the fork assembly retained at its normal lowered neutral non-shooting position by a biasing spring of the fork assembly.
Figure 8:
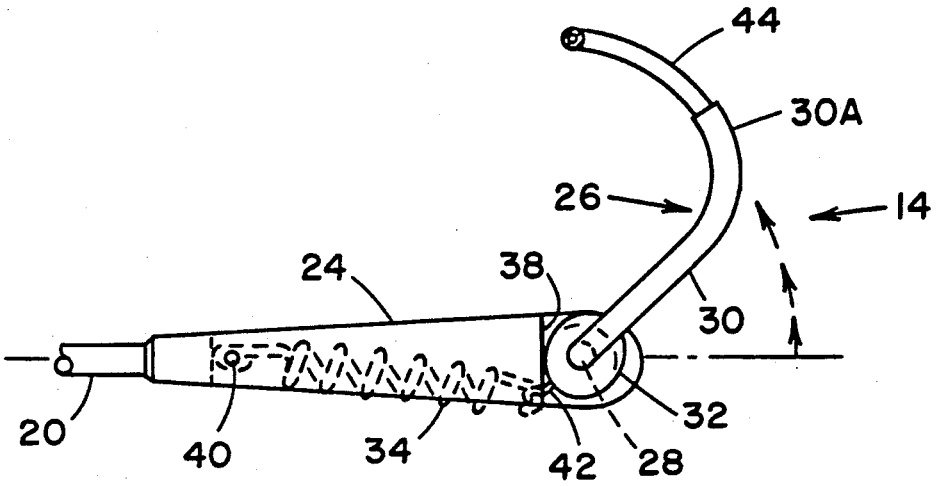
FIG. 8 is another view similar to that of FIG. 7, but showing the flip-fork pivoting against its spring bias toward its upright shooting position.
Figure 9:
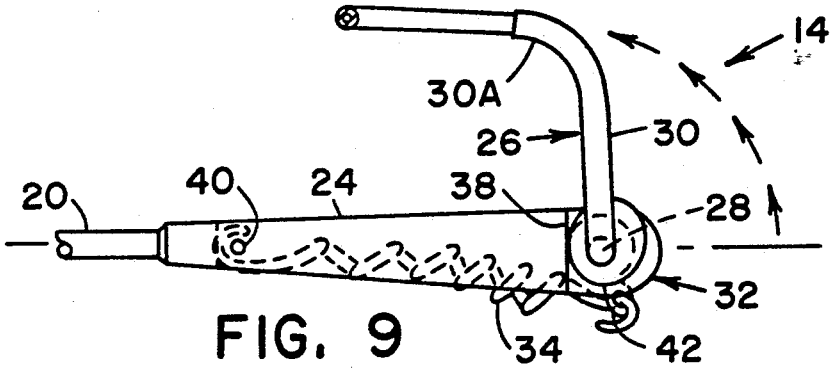
FIG. 9 is still another view similar to that of FIGS. 7 and 8, but showing the flip-fork at its upright shooting position.
Figure 12:
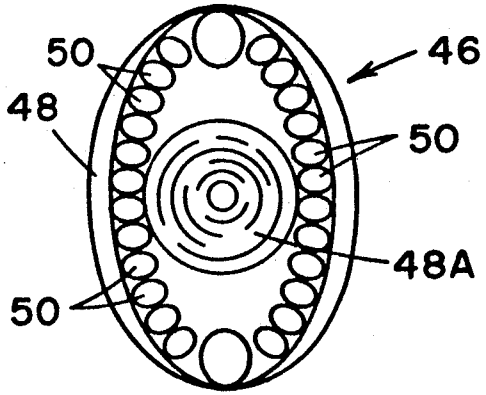
FIG. 12 is a front elevational view of the pouch and hand grip as seen along line 12—12 of FIG. 11.

Referring to FIGS. 7-9, the flip-fork 26 is pivotal about the transverse axis T and relative to the head element 24 between a lowered neutral non-shooting position, as seen in FIG. 7, and an upright shooting position, as seen in FIG. 9. The biasing spring 34 extends between the stop cam 32 and the rear portion of the head element 24 and, more particularly, is anchored at one end to the head element 24 by a roll pin 40 and at the opposite end to the stop cam 32 by an eyebolt 42. In such arrangement, the spring 34 biases the flip-fork 25 to normally assume its lowered neutral non-shooting position, shown in FIG. 9. Due to its eccentric mounting on the bight portion 28 of the flip-fork 26, the stop cam 32 which pivots or rotates with the flip-fork 26 will eventually make contact with the head element 24 at an elevation below or above the transverse axis T and at the rear of the slot 38, after approximately ninety degrees of either clockwise or counterclockwise movement of the flip-fork 26. In such manner, the stop cam 32 terminates pivotal movement of the flip-fork 26 upon reaching its respective lowered neutral and upright positions of FIGS. 7 and 9. The head element 24 is also hollow and the spring 34 can be located internally within the hollow head element 24, externally thereof or partly both.

Figure 11:
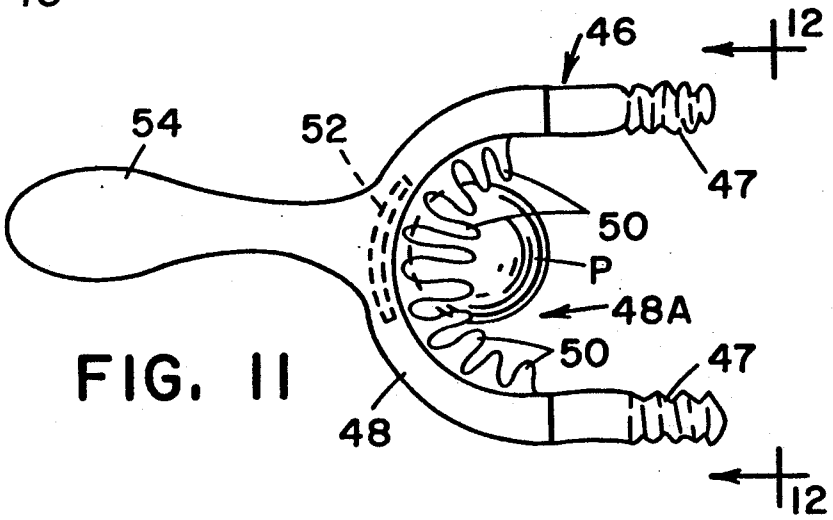
FIG. 11 is a top plan view of the pouch and hand grip of FIG. 10.
Figure 10:
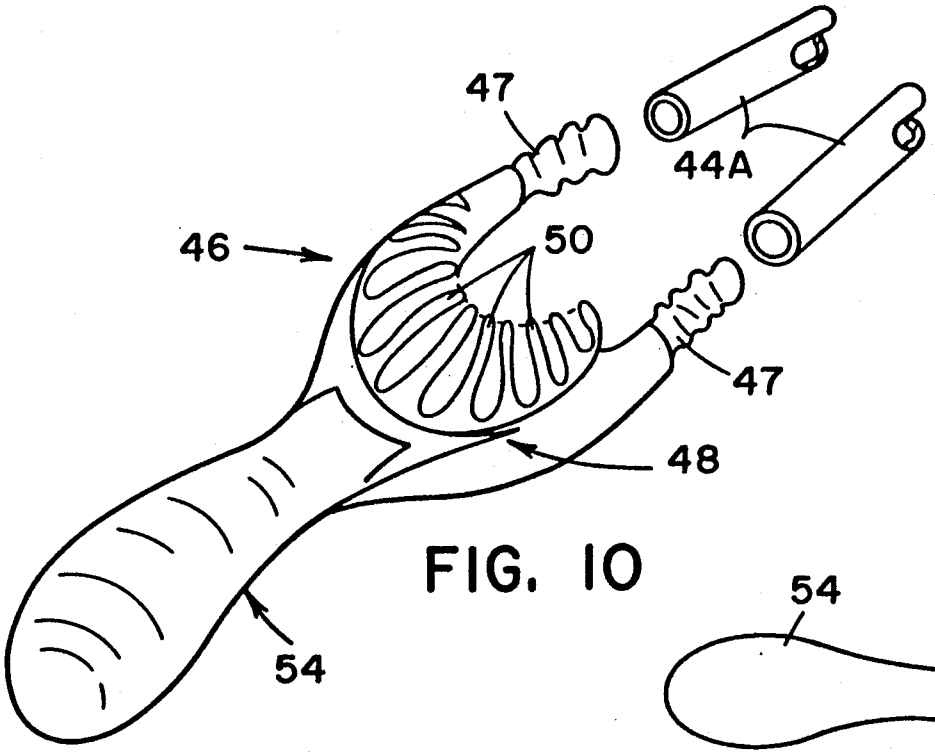
FIG. 10 is an enlarged exploded perspective view of a combined pouch and hand grip of the slingshot of FIG. 1, illustrating one arrangement for attaching legs of the pouch to the ends of the power band.

Referring again to FIGS. 1-3 and also to FIGS. 6-12, the other improved features incorporated by the slingshot 10 include a power sling or band 44 and means 46 for holding a projectile P, such as the round shot seen in FIG. 11. The holding means 46 has a pair of attachment legs 47 which extend forwardly from a pouch 48. The power band 44 composed of any suitable material, for example rubber tubing, elastic surgical hose or the like, is preferably of a single piece, being attached to the flip-fork 26 by extending through the hollow interior of its fork structure and from the rearwardly curved ends 30A of the flip-fork arm portions 30. At its opposite ends 44A, the power band 44 is connected to the attachment legs 47 of the holding means 46.

As mentioned, the flip-fork 26 is preferably hollow and, in the embodiment seen in FIG. 6, the power band 44 is in one piece, extending through the hollow interior of flip-fork 26 and from its open ends 30A so as to increase the amount of energy the band is capable of storing without increasing the length of the portions of the band 44 which extend from the flip-fork 26. This arrangement of attachment of the power band 44 to the flip-fork 26 also makes it easier to center the projectile P with the mid-point between the arm portions 30 of the flip-fork 26. Alternatively, the power band 44 can be two separate pieces connected in a frictional fit over the opposite ends 30A of the flip-fork 26, as shown in FIGS. 2 and 3. In this case, the fork structure of the flip-fork 26 can have the solid, rod-like configuration mentioned earlier.

The flip-fork 26 is pivotally moved against the bias imposed by the biasing spring 34, causing extension of the spring, from the lowered neutral non-shooting position (dashed line form in FIG. 2) to the upright shooting position (solid line form in FIGS. 2 and 14) upon rearward pulling and stretching of the power band 44 to load the slingslot for shooting the projectile p. Such pivotal movement of the flip-fork 26 to its upright shooting position thereby stores kinetic energy in the biasing spring 34 in addition to that being stored in the stretched power band 44.

It should be noted, also, upon release of the power band 44 in shooting the projectile p, the flip-fork moves back to its lowered neutral non-shooting position due to contraction of the spring 34 which imparts the extra stored energy to the projectile P in addition to that imparted by the contracting power band 44. The flip-fork 26 in moving to its neutral position assumes a location more or less in line with the head element 24 of the mainframe 12 and below the path of flight of the holding means 46 and projectile P so as to avoid being inadvertently struck by them as they move above past the fork assembly 14. Further, the offset nature of the head element 24 of the mainframe 12 with respect to the centerline CL of the slingshot 10 and the user's arm A and the line of force acting on the stretched power band 44 minimizes the recoil resulting from the release of the power band 44 upon shooting of the projectile P. This also enhances the user's ability to align the slingshot 10 with the respective target.

As mentioned above, the holding means 46 of the slingshot 10 includes the flexible pouch 48 for receiving the projection P. The pouch 48 has a peripheral arrangement of flex fingers 50 about the forward sides (upper and lower edges) of its pocket 48A which are capable of retaining the projectile P once positioned therein without the necessity of continually gripping it through the pouch 48. Further, a magnetic element 52 can be attached to the pocket pouch 48 to assist in retaining a ferrous projectile therein until the pouch reaches the end of its travel upon release of the stretched power band 44. In addition the pouch 48 has a gripping element 54 attached in pigtail fashion at its rearward side for grasping by the other hand of a user for pulling and stretching the power band 44.

Figure 16:
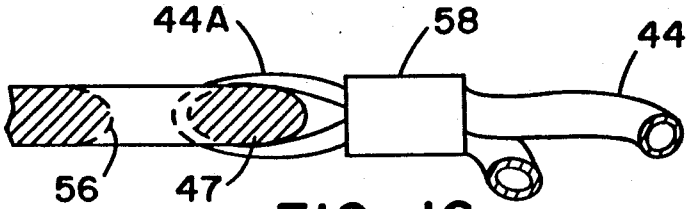
FIG. 16 is a fragmentary elevational view of another arrangement for attaching the legs of the pouch of FIG. 15 to the ends of the power band.
Figure 15:
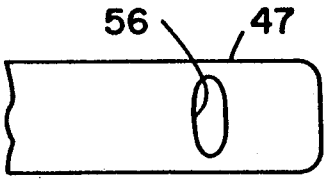
FIG. 15 is a fragmentary elevational view of an alternative embodiment of the attachment legs of the pouch.

FIGS. 15 and 16 illustrate an alternative way of connecting the ends of the power band 44 to the attaching legs 47 of the holding means 46. An opening 56 is provided in each leg 47 and a stretchible sleeve 58 is inserted on the respective one end 44A of the power band 44. Thereafter, the power band end is inserted through the opening 56 and looped back onto itself. Finally, the sleeve 58 is stretched and pulled over doubled back portions of the one end 44A of the power band 44.

It is thought that the present invention and many of its attendant advantages will be understood from the foregoing description and various changes may be made in the form, construction and arrangement of the parts thereof without departing from the spirit and scope of the invention or sacrificing all of its material advantages, the forms hereinbefore described being merely preferred or exemplary embodiments thereof.

Having thus described the invention, what is claimed is:

1. A slingshot, comprising:

(a) an elongated mainframe having opposite forward and rearward ends and including means for holding said mainframe by a user's hand;

(b) a fork assembly pivotally mounted to said forward end of said mainframe about a transverse axis and including a flip-fork pivotally movable between an upright shooting position and a lowered neutral non-shooting position and means resiliently biasing said flip-fork to normally assume its neutral non-shooting position;

(c) means for holding a projectile; and (d) an elastic power band connected to said flip-fork and having elongated portions extending therefrom to a pair of opposite ends connected to said holding means, said flip-fork being pivotally movable against the bias of said biasing means from said neutral non-shooting position to said upright shooting position upon stretching of said power band to load said slingslot for shooting the projectile such that, upon being moved to said upright shooting position, said flip-fork stores energy in said biasing means in addition to that being stored in said power band as the latter is stretched to load the slingshot;

(e) said flip-fork including a fork structure having a hollow interior and being composed of a middle bight portion pivotally mounted to said mainframe and a pair of arm portions connected to opposite ends of said bight portion and extending in transverse relation thereto, said arm portions terminating in open ends communicating with said hollow interior of said fork structure;

(f) said power band being a single continuous piece extending through said hollow interior of said middle bight portion and arm portions of said fork structure with said elongated portions of said band extending from said open ends of said arm portions of said fork structure so as to increase the amount of energy said band is capable of storing without increasing the lengths of said elongated band portions which extend from said fork structure.

2. The slingshot as recited in claim 1, wherein said biasing means is a spring attached between said flip-fork and said mainframe.

3. The slingshot as recited in claim 1, wherein said fork assembly further includes a stop element mounted on said flip-fork and being engagable with said mainframe to terminate pivotal movement of said flip-fork upon reaching its upright and neutral positions.

4. The slingshot as recited in claim 3, wherein said stop element is an eccentrically-mounted cam.

5. The slingshot as recited in claim 1, further comprising:

means located at said rearward end of said mainframe for securing said mainframe to a user's forearm adjacent to the elbow.

6. The slingshot as recited in claim 5, wherein said securing means is fastenable and unfastenable strap.

7. The slingshot as recited in claim 1, wherein said holding means of said mainframe is a hand grip located intermediate between said forward and rearward ends of said mainframe.

8. The slingshot as recited in claim 7, wherein said mainframe further includes a rearward frame portion extending rearwardly of said hand grip to said rearward end of said mainframe, said rearward frame portion being connected to a lower end of said hand grip for placement under a user's wrist and forearm when said hand grip is held by the user's hand.

9. The slingshot as recited in claim 7, wherein said mainframe further includes a forward frame portion extending forwardly of said hand grip to said forward end of said mainframe, said forward frame portion having a head element located at said forward end of said mainframe which pivotally mounts said flip-fork of said fork assembly about said transverse axis.

10. The slingshot as recited in claim 9, wherein said forward frame portion is connected to an upper end of said hand grip and extends in inclined forwardly and downwardly relation to said upper hand grip end so as to position said head element on a centerline through a user's arm and hand holding said mainframe.

11. The slingshot as recited in claim 9, wherein:

said head element on said forward frame portion has a slot therein; and said fork assembly further includes a stop element mounted on said flip-fork for pivotal movement therewith, said stop element disposed in said slot of said head element and being engagable with said head element to terminate pivotal movement of said flip-fork upon reaching its upright and neutral positions.

12. The slingshot as recited in claim 11, wherein said stop element is an eccentrically-mounted cam.

13. The slingshot as recited in claim 11, wherein said biasing means is a spring attached between said stop element and head element.

14. The slingshot as recited in claim 13, wherein said head element is hollow and said spring is located internally within said head element.

15. The slingshot as recited in claim 1, wherein said means for holding the projectile includes a pouch for receiving the projectile and being capable of retaining the projectile once positioned therein without the necessity of continually gripping it through said pouch.

16. The slingshot as recited in claim 15, wherein said pouch includes a magnetic element for retaining the projectile therein.

17. The slingshot as recited in claim 1, wherein said means for holding the projectile includes a pouch for receiving the projectile and said slingshot further comprising a gripping element attached to said pouch for grasping by the other hand of a user for pulling and stretching said power band.

18. A slingshot, comprising:

(a) an elongated mainframe having opposite forward and rearward ends and including means for holding said mainframe by a user's hand;

(b) a fork assembly mounted to said forward end of said mainframe and including a fork structure having a hollow interior and a pair of opposite open ends;

(c) means for holding a projectile; and (d) an elastic power band connected to said fork structure of said fork assembly and having elongated portions extending therefrom to a pair of opposite ends connected to said holding means;

(e) said fork structure being composed of a middle bight portion pivotally mounted to said mainframe and a pair of arm portions connected to opposite ends of said bight portion and extending in transverse relation thereto, said arm portions terminating in open ends communicating with said hollow interior of said fork structure;

(f) said power band being a single continuous piece extending through said hollow interior of said middle bight portion and arm portions of said fork structure with said elongated portions of said band extending from said open ends of said arm portions of said fork structure so as to increase the amount of energy said band is capable of storing without increasing the lengths of said elongated band portions which extend from said open ends of said fork structure.

19. The slingshot as recited in claim 18, wherein said holding means of said mainframe is a hand grip located intermediate between said forward and rearward ends of said mainframe.

20. The slingshot as recited in claim 19, wherein said mainframe further includes a rearward frame portion extending rearwardly of said hand grip to said rearward end of said mainframe, said rearward frame portion being connected to a lower end of said hand grip for placement under a user's wrist and forearm when said hand grip is held by the user's hand.

21. The slingshot as recited in claim 19, wherein said mainframe further includes a forward frame portion extending forwardly of said hand grip to said forward end of said mainframe, said forward frame portion having a head element located at said forward end of said mainframe which pivotally mounts said flip-fork of said fork assembly about said transverse axis.

22. The slingshot as recited in claim 21, wherein said forward frame portion is connected to an upper end of said hand grip and extends in inclined forwardly and downwardly relation to said upper hand grip end so as to position said head element on a centerline through a user's arm and hand holding said mainframe.

23. A slingshot, comprising:

(a) an elongated mainframe having opposite forward and rearward ends and including a hand grip located intermediate of said forward and rearward ends for holding said mainframe by a user's hand;

(b) said mainframe further including a rearward frame portion extending rearwardly of said hand grip to said rearward end of said mainframe, said rearward frame portion being connected to a lower end of said hand grip for placement under a user's wrist and forearm when said hand grip is held by the user's hand, and a forward frame portion extending forwardly of said hand grip to said forward end of said mainframe, said forward frame portion being connected to an upper end of said hand grip and extending in inclined forwardly and downwardly relation to said upper hand grip end so as to position said forward end of said mainframe on a centerline through a user's arm and hand holding said mainframe;

(c) means located at said rearward end of said mainframe for securing said mainframe to the user's forearm adjacent to the elbow thereof;

(d) a fork assembly pivotally mounted to said forward end of said mainframe about a transverse axis and including a flip-fork pivotally movable between an upright shooting position and a lowered neutral non-shooting position and means resiliently biasing said flip-fork to normally assume its neutral non-shooting position;

(e) means for holding a projectile; and (f) an elastic power band connected to said flip-fork and having elongated portions extending therefrom to a pair of opposite ends connected to said holding means, said flip-fork being pivotally movable against the bias of said biasing means from said normal neutral non-shooting position to said upright shooting position upon stretching of said power band to load said slingslot for shooting the projectile such that, upon being moved to said upright shooting position, said flip-fork stores energy in said biasing means in addition to that being stored in said power band as the latter are stretched to load the slingshot and, upon moving to said neutral non-shooting position, said flip-fork improves slingshot performance by assuming a location below the path of flight of said holding means and projectile so as to avoid being inadvertently struck by the projectile and said holding means as they move past said fork assembly.

24. The slingshot as recited in claim 23, wherein said fork assembly further includes a stop element mounted on said flip-fork and pivotally movable therewith, said stop element being engagable with said forward frame portion to terminate pivotal movement of said flip-fork upon reaching its upright and neutral positions.

25. The slingshot as recited in claim 24 wherein said biasing means is a spring attached between said stop element on said flip-fork and said forward frame portion.

26. The slingshot as recited in claim 24, wherein said stop element is an eccentrically-mounted cam.

27. The slingshot as recited in claim 26 wherein said biasing means is a spring attached between said cam on said flip-fork and said forward frame portion.

* * * * *